US005771823A

United States Patent [19]

Vierstra et al.

[11] Patent Number: 5,771,823

[45] Date of Patent: Jun. 30, 1998

[54] METHOD AND APPARATUS FOR REDUCING $NO_X$ EMISSIONS FROM A MULTIPLE-INTERTUBE PULVERIZED-COAL BURNER

[75] Inventors: Scott A. Vierstra, Canal Winchester; John J. Letcavits, Hilliard, both of Ohio

[73] Assignee: AEP Resources Service Company, Columbus, Ohio

[21] Appl. No.: 594,855

[22] Filed: Jan. 31, 1996

[51] Int. Cl.[6] ..... F23D 1/00; F23J 3/00

[52] U.S. Cl. ..... 110/347; 110/345

[58] Field of Search ..... 110/345, 347, 110/265

[56] References Cited

U.S. PATENT DOCUMENTS

| | | | |
|---|---|---|---|
| 2,397,793 | 4/1946 | Leach | 110/28 |
| 3,781,162 | 12/1973 | Rudd et al. | 431/115 |
| 3,788,796 | 1/1974 | Krippene et al. | 431/2 |
| 4,654,001 | 3/1987 | LaRue | 431/354 |
| 4,655,148 | 4/1987 | Winship | 110/347 |
| 4,669,398 | 6/1987 | Takahashi et al. | 110/347 |
| 4,748,919 | 6/1988 | Campobenedetto et al. | 110/264 |
| 4,907,962 | 3/1990 | Azuhata et al. | 431/174 |
| 5,078,064 | 1/1992 | Breen et al. | 110/212 |
| 5,199,355 | 4/1993 | LaRue | 110/261 |
| 5,205,226 | 4/1993 | Kitto, Jr. et al. | 110/264 |
| 5,329,866 | 7/1994 | LaRue | 110/265 |
| 5,417,564 | 5/1995 | Briggs | 110/263 |

*Primary Examiner*—James C Yeung
*Assistant Examiner*—Nhat-Hang H. Lam
*Attorney, Agent, or Firm*—Sand & Sebolt

[57] ABSTRACT

A method and apparatus retrofitted to a multiple-intertube pulverized-coal burner to reduce $NO_x$ emissions of roof fired boilers. An internal two stage process controls the amount of secondary air which flows to the burner. The first stage includes a secondary air damper and air flow station to regulate the amount of air which flows into a windbox of the burner. A baffle plate assembly which includes a plurality of baffle plates further limits the amount of air which flows to the core of the burner for combustion of the fuel. The baffle plates create a pressure drop within the windbox which forces or diverts a quantity of air to the periphery of the burner. The second stage includes an outlet formed in the hot primary air duct, an air plenum which communicates therewith, and a plurality of interjectory air ports which correspond with the burners in number and position along a front wall of the boiler and which communicate with the air plenum. The interjectory air ports inject interjectory air into a combustion chamber of the boiler at a substantially 90 degree angle to the direction of a plurality of burner tips of each burner and supplies the balance of the required theoretical combustion air needed to complete combustion of the fuel. A plurality of probes measure the amount of primary air, secondary air and interjectory air and signal a command loop circuit to adjust the secondary air dampers and interjectory air ports accordingly.

10 Claims, 5 Drawing Sheets

FIG-6
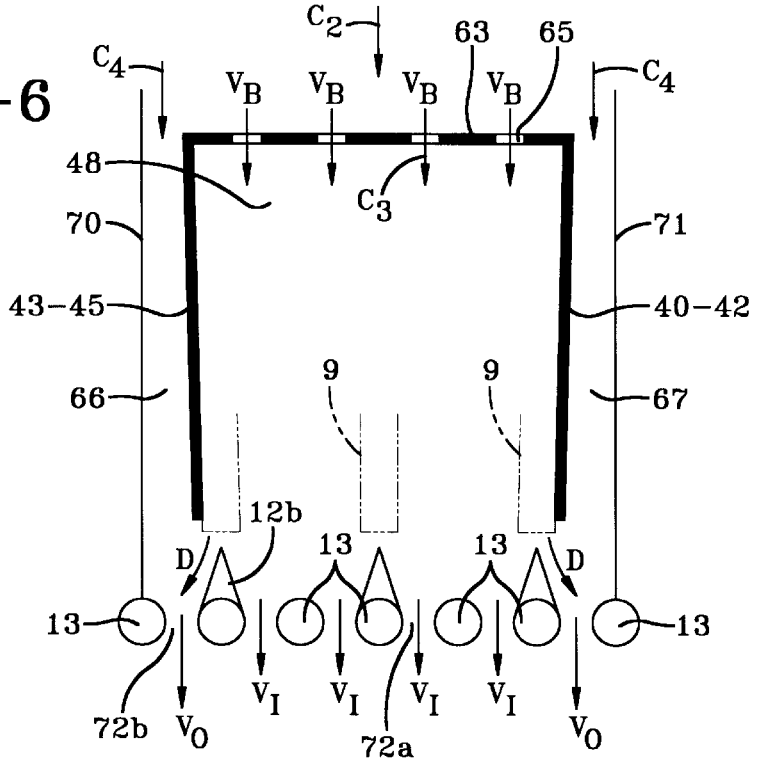
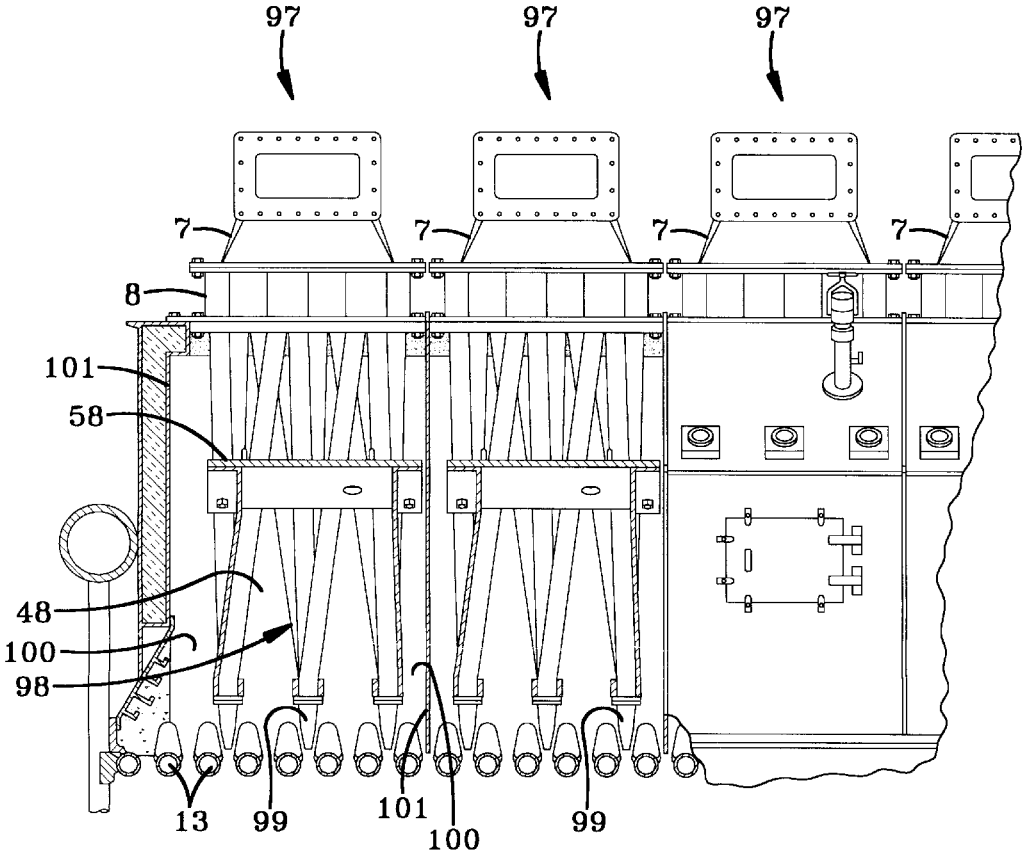
FIG-7

METHOD AND APPARATUS FOR REDUCING $NO_x$ EMISSIONS FROM A MULTIPLE-INTERTUBE PULVERIZED-COAL BURNER

BACKGROUND OF THE INVENTION

1. Technical Field

The invention relates to a method and apparatus for reducing the $NO_x$ output of slotted roof fired boilers. More particularly, the invention relates to a method and apparatus which is retrofitted to existing multiple-intertube pulverized-coal burners to reduce the $NO_x$ output of the burners. Even more particularly, the invention relates to a method and apparatus using air staging ports and air baffles within the windbox of the multiple-intertube pulverized-coal burners to reduce the $NO_x$ output of slotted roof fired boilers to meet the proposed standards of the Clean Air Act.

2. Background Information

Electric power plants require some form of initial energy to produce the steam that powers the generators to produce electricity. One type of initial energy is heat produced from the burning of pulverized coal in a multiple-intertube pulverized-coal burner. The pulverized coal or fuel is carried into the burners of a slotted roof fired boiler by a primary air flow. A quantity of secondary air is then provided at the burner tips and mixes with the primary air/fuel mixture. The secondary air supplies about 80% of the total air required for combustion while the primary air provides the remaining 20%. Combustion occurs and the boilers then produce the steam which is subsequently converted into electrical energy by the steam driven turbines. Conventionally, the secondary air is introduced through a windbox and distributed to the individual burners. This allows for sufficient oxygen atoms to be present in the burners to burn the coal's volatile (hydrocarbon) content and the fuel's fixed carbon atoms.

During the combustion process, nitrogen trapped in the coal particle is released and, in the presence of excess oxygen, can combine to form nitric oxide (NO), or nitrogen dioxide ($NO_2$), both of which are classified as pollutants. When both gases are referenced simultaneously they are referred to as $NO_x$. Similarly, under the intense thermal environment of a furnace or combustion chamber, atmospheric nitrogen can disassociate into nitrogen atoms which can then combine with excess oxygen to form $NO_x$. The Clean Air Act addresses the amount of these gases that these burners may emit and new standards must be complied with by the year 2000. The method and apparatus of the present invention reduces the $NO_x$ emissions from existing multiple-intertube pulverized-coal burners in order to meet the requirements of the Clean Air Act.

Many prior art apparatuses have attempted to reduce the level of $NO_x$ emissions from various coal burning boilers in an effort to meet the government standards set forth in the Clean Air Act and to prevent the discharge of such gases into the surrounding atmosphere.

U.S. Pat. No. 5,414,564 shows a method and apparatus which alters the firing pattern of the burners. A panel is cut-out of the furnace wall and reinstalled in a reverse orientation to provide a greater spacing or staging distance between first and second burners.

U.S. Pat. No. 5,329,866 shows a burner and port combination which includes a throat, a burner nozzle positioned at a central area of the throat, a secondary air tube positioned laterally adjacent the burner nozzle and a plurality of vanes positioned at an upper portion of the throat above the burner nozzle.

U.S. Pat. No. 5,199,355 shows a low $NO_x$ short flame burner which includes a central nozzle pipe having an inner surface with a portion which diverges outwardly. An axially movable plug positioned within the nozzle pipe is axially moved to increase and decrease the velocity of a fuel and air mixture thus reducing the formation of $NO_x$ and the length of the flame produced by the burner.

Although these prior art apparatuses may be adequate for the purpose for which they were intended, these prior art devices fail to solve the emission problems of existing slotted roof fired boilers. Thus, the need exists for a method and apparatus for reducing the $NO_x$ emissions from slotted roof-fired boilers.

The method and apparatus of the present invention reduces the level of $NO_x$ emissions in these slotted roof fired boilers to meet the proposed new standards of the Clean Air Act while minimizing any detrimental impact on combustion efficiency. The method and apparatus of the present invention uses an internal two stage combustion process to reduce the $NO_x$ emissions which uses commercially available air flow instrumentation to control the amount of air inputs into the burners, which provides better uniformity of flame chemistry across the unit and over the full load range than the previous methods and apparatuses, and which has a relatively low installation cost. The use of interjectory air produces a reduction in the thermal $NO_x$ by enlarging the flame envelope and internal burner air staging produces a reduction in both the thermal and fuel $NO_x$ by reducing the available oxygen at the root of the flame where rapid devolatization of the pulverized coal occurs and by reducing turbulence and mixing of the combustion air and fuel at the root of the flame. There is no such method and apparatus of which we are aware which accomplishes these results.

SUMMARY OF THE INVENTION

The method and apparatus of the present invention controls the amount of secondary air and supplies the secondary air to the burners in an internal two stage process. The first stage includes secondary air dampers and air flow stations which regulate the amount of secondary air to the burners. A portion or balance of the required secondary air is directed through hot air ducts to interjectory air plenums located along the furnace front wall. The secondary air flowing directly to the burners is baffled to provide a low velocity, fuel rich central core for combustion of the fuel's volatile component in a reducing environment. The periphery of the burner maintains an oxygen rich boundary layer which protects against reducing environments along waterwalls and corrosion potentials and provides sustained combustion of the fixed carbon.

The second stage of the process then uses one modulating interjectory air port per burner to provide the balance of the required total combustion air and sufficient turbulence to complete the combustion process. This two stage process provides for a precise measurement of both secondary and interjectory air to the burners at all times, allowing enough combustion air to support both the burning of the fuel's volatile component and the fixed carbon while limiting the supply of excess oxygen, thus reducing the potential for the fuel bound nitrogen released with the burning of the volatile component and atmospheric nitrogen from being converted to $NO_x$. Instead, the fuel nitrogen atoms combine forming inert $N_2$ gas.

Therefore, in accordance with the above, objectives of the present invention include providing a method and apparatus for reducing $NO_x$ emissions from slotted roof-fired boilers by retrofitting multiple-intertube pulverized-coal burners with secondary air baffles to redistribute the secondary air within the burner and with modulating interjectory air ports (one per burner) while regulating the two air flows to match the actual coal flow to each burner, thus maintaining uniform combustion chemistries.

Another objective of the present invention is to provide such a method and apparatus which provides a right angle relationship between the burners and the respective interjectory air streams to assist turbulence and complete carbon burnout.

A still further objective of the present invention is to provide such a method and apparatus which uses commercially available air flow instrumentation to provide feedback and damper position for automatic secondary air flow control based upon actual pulverizer throughputs.

Another objective of the present invention is to provide such a method and apparatus which develops an enlarged flame envelope and uniform flame chemistry which reduces thermal $NO_x$ emissions yet maintains combustion efficiency.

A further objective of the present invention is to provide such a method and apparatus which reduces quantities of $NO_x$ emission while minimizing any impact on the cost of producing electrical power.

Another objective of the present invention is to maximize the cost effectiveness of Clean Air Act compliance and minimize furnace pressure part modifications.

These objectives and advantages are obtained by the method of the present invention the general nature of which may be stated as including the steps of providing a plurality of burner tips which communicate with the combustion chamber of the boiler; providing a supply of heated air; dividing the heated air into a supply of primary combustion air and a supply of secondary combustion air; directing the first portion of secondary combustion air toward the burner tips; directing the second portion of secondary air and the primary combustion air through a hot primary air duct toward a source of pulverized coal; redirecting a second portion of the secondary combustion air into an air plenum; injecting individual streams of the redirected secondary combustion air from the air plenum and into the combustion chamber of the boiler, one stream for each of the burners; and combining primary combustion air and pulverized coal with the first portion of the secondary combustion air adjacent the burner tips to provide the initial combustion air.

These objectives and advantages are further obtained by the apparatus of the present invention the general nature of which may be stated as including baffling means for directing a first portion of a supply of secondary combustion air to a plurality of burner tips of certain of the burners and for redirecting a second portion of the supply of secondary combustion air through a hot primary air duct; an outlet formed in the hot primary air duct; an inlet to an interjectory air plenum which communicates with said outlet for redirecting the second portion of the supply of secondary combustion air; an opening formed in a front wall of the boiler for each of said certain burners; and an interjectory air port for each of said certain burners which communicates with the air plenum for interjecting the redirected air into the combustion chamber through said front wall openings.

BRIEF DESCRIPTION OF THE DRAWINGS

The preferred embodiment of the invention, illustrative of the best mode in which applicants have contemplated applying the principles, is set forth in the following description and is shown in the drawings and is particularly and distinctly pointed out and set forth in the appended claims.

FIG. 6 is a diagrammatic view of the baffles and water tubes of the boiler shown in FIG. 1, showing the relative air velocities of the secondary air;

FIG. 7 is a view similar to FIG. 4 showing a modified multiple-intertube pulverized-coal burner with burner nozzles extending between the water tubes;

Similar numbers refer to similar parts throughout the drawings.

DESCRIPTION OF THE PREFERRED EMBODIMENT

Figure 1:
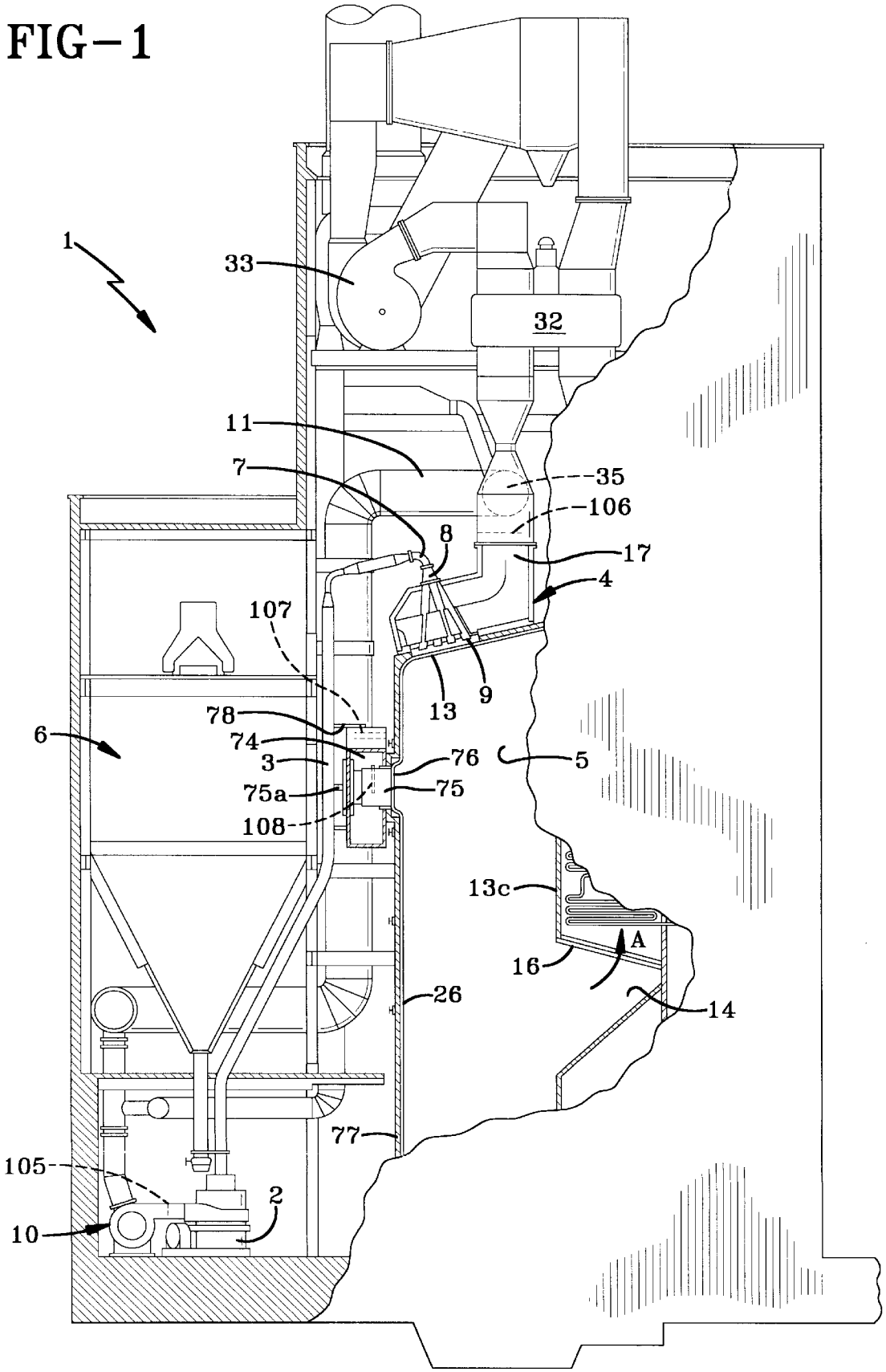
FIG. 1 is a diagrammatic sectional view with portions broken away and in section of a boiler retrofitted in accordance with the present invention.

Referring to FIG. 1 of the drawings, there is shown therein one type of an intertube roof fired boiler indicated generally as 1. Boiler 1 usually includes a series of coal pulverizing mills 2 which pulverize the coal which is then carried by a supply of primary combustion air through a plurality of coal pipes 3 and into a multiple-intertube pulverized-coal burner 4, shown particularly in FIGS. 2, 3 and 4, for subsequent combustion within a combustion chamber 5. A usual roof fired boiler generally includes a number of burners 4 which correspond to the mills 2, typically feeding two burners. A change of direction opening 14 is formed near the bottom of combustion chamber 5 and allows the gases created during combustion to pass through a convection pass screen 16 and up and out of boiler 1, as shown by arrow A, FIG. 1. The coal and primary air travel into burner 4 in the direction of arrow B (FIGS. 2 and 3) through a distributor elbow 7 and a riffle casting 8. Riffle casting 8 distributes the coal and primary air to a plurality of burner tips 9 which extend downwardly at various angles to the bottom of burner 4 and which communicate with combustion chamber 5.

Figure 2:
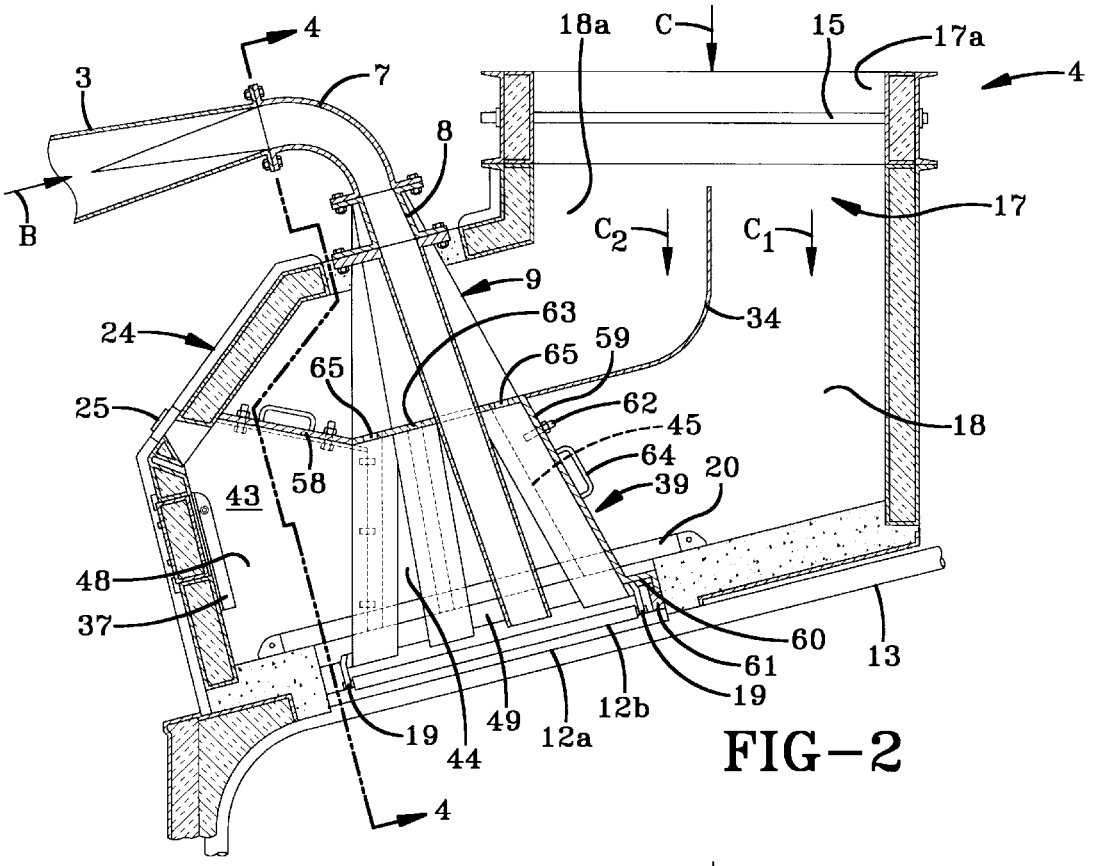
FIG. 2 is an enlarged sectional view of a multiple-intertube pulverized-coal burner with secondary air baffles of the present invention installed, taken along line 2—2, FIG. 4.
Figure 3:
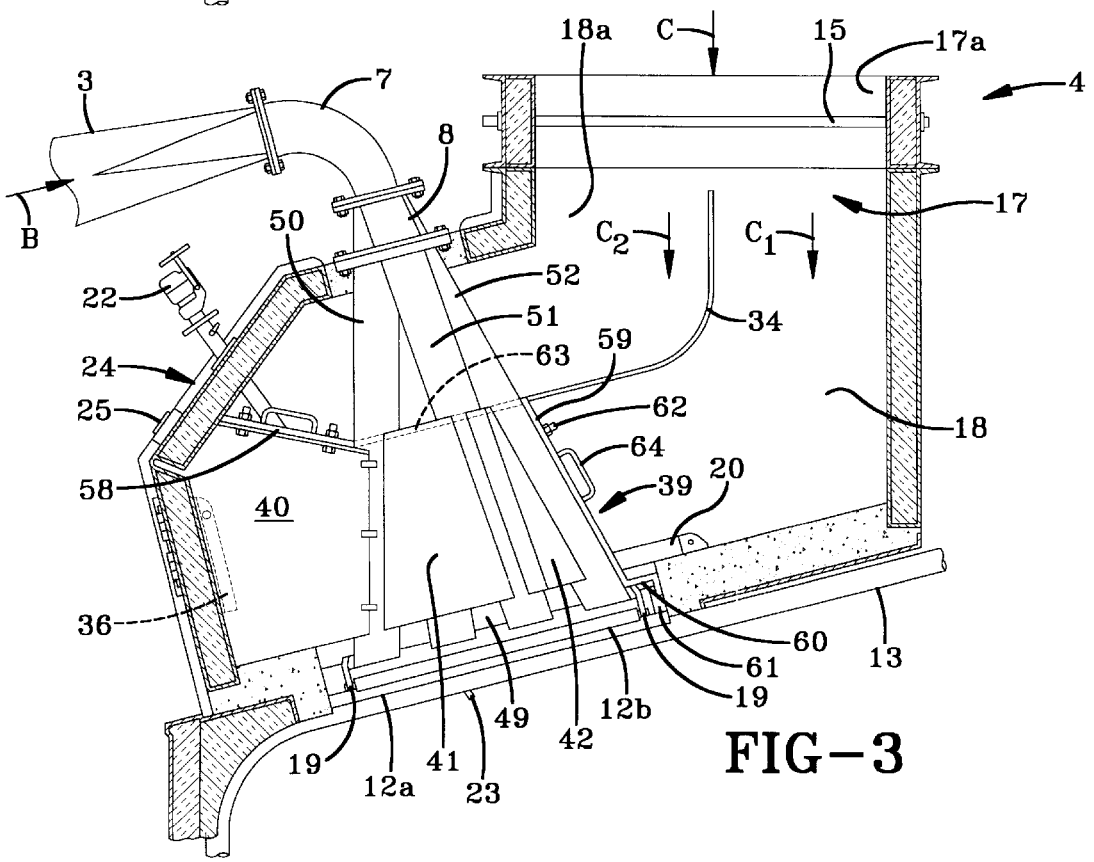
FIG. 3 is an enlarged sectional view of the burner of FIG. 2 taken along line 3—3, FIG. 4.

A quantity of secondary combustion air which is shown by arrow C in FIGS. 2 and 3, is required at the discharge ends of burner tips 9 to mix with the fuel and primary air mixture and support combustion. The secondary air flows through a secondary air damper 15 and into a burner windbox compartment 17 and provides the additional air which is needed at the discharge ends of burner tips 9 to provide an initial combustion air to support the combustion of the coal. Burner tips 9 extend through windbox 17 and terminate slightly above a plurality of tube protectors 12*a* and steeple castings 12*b*, best shown in FIG. 4, which shield a plurality of usual furnace roof water tubes 13 from direct impingement of the air and fuel streams. Roof tubes 13 extend along and form the roof of combustion chamber 5 (FIG. 1) and are connected to a plurality of corresponding front wall water tubes 26. Similarly, additional tubing 13*b* and 13*c* form the side and rear walls of combustion chamber 5.

Burner tips 9 are supported above steeple castings 12*b* by tip supports 19 (FIGS. 2 and 3) and are separated from one another by a tip spacer 20. An oil or gas atomizer 22 (FIG. 3) extends from a front 24 of burner 4 through windbox 17 and terminates in an oil atomizer tip 23 slightly below roof tubes 13. A start-up lighter 22 is used as an ignition source to initially light the coal streams from burner tips 9. After stable coal ignition is established, the start-up lighter 22 and atomizer tip 23 are retracted to a terminal position above roof tubes 13. Observation windows 25 (FIGS. 2, 3 and 4) are also formed in front 24 of burner 4 and allow burner tips 9 and the flame produced therefrom to be viewed from outside of burner 4. Windbox 17 can be accessed for maintenance and the like through a windbox access door 29 (FIG. 4) hingedly connected to burner 4 and held shut by pivoting tabs 30. Windbox 17 is generally L-shaped (FIGS. 2 and 3) and has a windbox opening 17*a* formed at a top thereof. Windbox opening 17*a* allows the secondary air to flow into and through windbox 17 to burner tips 9. A curved windbox partition 34 extends transversely across windbox 17 and separates windbox 17 and thus the secondary combustion air, into two flow chambers 18 and 18*a*.

The combustion air is supplied by a forced draft fan 33 and is preheated as it passes through an air heater 32. Originally approximately 15% to 20% of the preheated combustion air was diverted to the pulverizers via plenum openings 35 and through primary air ducts 11.

The combustion air after passing through air heaters 32 is divided into the primary combustion air which is directed through hot primary air duct 11 and the secondary combustion air which is directed through secondary air dampers 15 (FIGS. 1, 2 and 3) in the direction of arrow C (FIGS. 2 and 3) and toward burner tips 9. Prior to the retrofitting of boiler 1, as described further below, windbox partition 34 separated air flow C into two paths shown by arrows $C_1$ and $C_2$ in order to provide improved flow distribution within the burner. Dampers 15 were and still are adjustable to control the amount of secondary air that flows into windbox 17. This secondary air thus supplies to the burners the major portion of oxygen needed to burn the coal's volatile (hydrocarbon) content and the coal's fixed carbon atoms.

Figure 4:
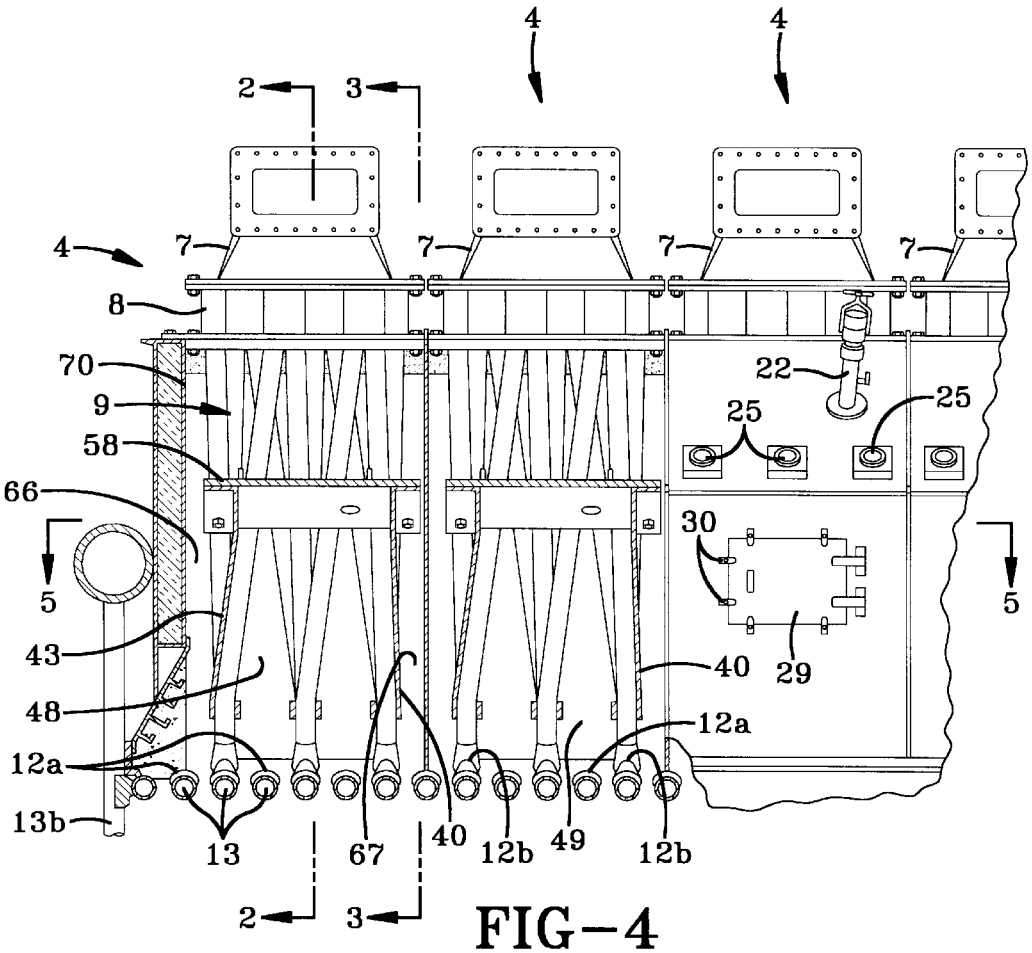
FIG. 4 is a fragmentary front elevational view of the burner of FIG. 2 with portions in section.

In operation, coal is fed from a coal bin 6 (FIG. 1) into mills 2 where the coal is pulverized into a dust-like form. A booster fan 10 boosts the primary air flow from hot primary air duct 11 to dry and carry the pulverized coal up coal pipes 3 and through distributor elbow 7 and into riffle casting 8. The coal is blown through riffle casting 8 where it is separated and distributed through burner tips 9. The coal exits burner tips 9 and is directed along the sides of steeple castings 12*b* (FIGS. 2, 3 and 4). Combustion then occurs beneath roof tubes 13 within combustion chamber 5.

Conventionally, the primary air flowing through burner tips 9 which carries the coal to the burner supplies approximately 20% of the required combustion air, and the secondary air flowing into windbox 17 supplies the remaining 80% of the required combustion air plus on the order of 15% excess air. During the combustion process in combustion chamber 5, nitrogen trapped in the coal particles is released and, in the presence of excess oxygen, can combine to form $NO_x$. Similarly, under the intense thermal environment within combustion chamber 5, atmospheric nitrogen can disassociate into nitrogen atoms which can then combine with excess oxygen to form $NO_x$.

In accordance with one of the features of the invention, the amount of secondary air supplied to the burner tips is limited by a baffle plate assembly indicated generally at 39 (FIGS. 2 and 3). Baffle plate assembly 39 includes a plurality of vertically and horizontally extending baffle plates which enclose lower portions of burner tips 9. One side of baffle plate assembly 39 includes a baffle plate 40. Baffle plate 40 is bolted to front wall 24 of burner 4 by an L-shaped bracket 36 and extends rearwardly to a front outboard burner tip 50. A middle baffle plate 41 extends between burner tip 50 and a middle burner tip 51 and a rear baffle plate 42 extends between burner tip 51 and a rear burner tip 52.

Figure 5:
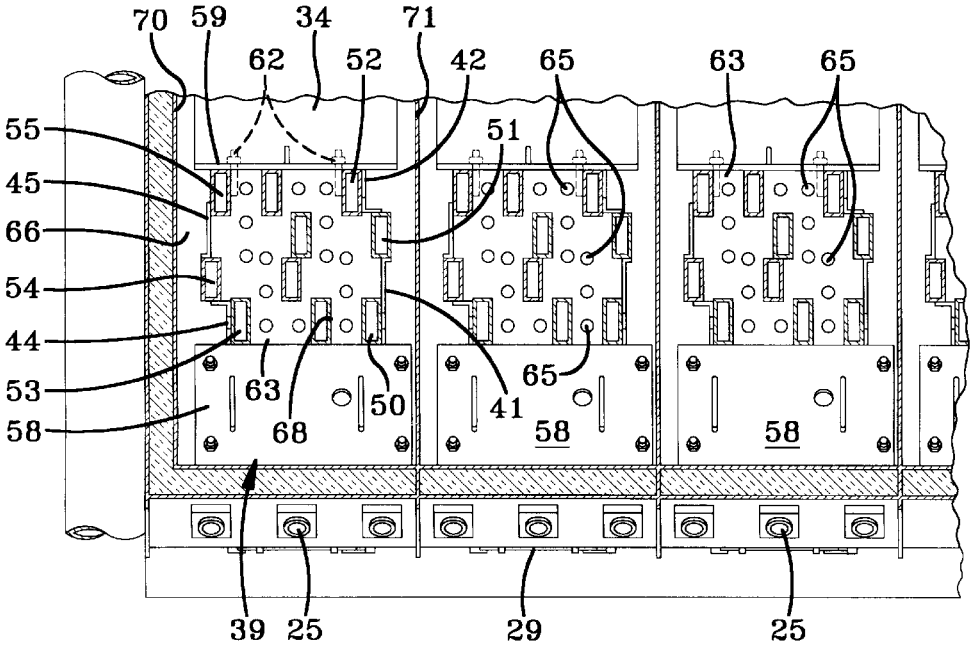
FIG. 5 is a sectional view of the burner of FIG. 2 taken along line 5—5, FIG. 4.

The other side of baffle plate assembly 39 includes a baffle plate 43 (FIGS. 2 and 4) which is a mirror image in shape to baffle plate 40. Baffle plate 43 is bolted to front wall 24 of burner 4 by an L-shaped bracket 37 and extends to a front outboard burner tip 53. A baffle plate 44 which is identical in shape to baffle plate 42, extends between burner tip 53 and a middle burner tip 54. A rear baffle plate 45 which is identical in shape to baffle plate 41, extends between burner tip 54 and a rear burner tip 55. Baffles 41, 42, 44 and 45 are preferably tack welded to the respective burner tips, but they may be attached in other ways without affecting the concept of the invention. Similarly, if the number of burners tips 9 varies from a quantity of 10 (i.e. 12), as shown in FIGS. 4 and 5, these baffle plates would be adjusted accordingly. Baffles 40 and 43 are clipped to burner tips 50 and 53, respectively, in order to facilitate removal for burner maintenance.

A front horizontal baffle plate 58 extends between front wall 24 and the front burner tips (FIGS. 2, 3 and 5), and a back generally vertical baffle plate 59 extends along the back burner tips between windbox partition 34 and tip support 19. Baffle plate 58 is bolted to the top edges of side baffle plates 40 and 43 (FIGS. 2 and 3). Baffle plate 59 is attached to the rear burner tips by a pair of nuts, washers fastened to a pair of threaded studs 62 which extend from the rear burner tips. Baffle plate 59 terminates in a generally L-shaped bottom flange 60 which is supported by tip support 19 (FIGS. 2 and 3) and baffle clips 61. Baffle plates 40, 43, 58 and 59 are removable to allow for maintenance of the burner tips. Baffle plates 58 and 59 include a pair of spaced parallel handles 64 for ease of removal.

A gap 66 is formed between wall 70 of burner 4 and baffle plates 43–45 and a gap 67 is formed between opposite wall 71 and baffle plates 40–42 (FIGS. 4–6) for directing a quantity of the secondary air into combustion chamber 5, the purpose of which is discussed further below.

In accordance with another feature of the invention, top baffle plates 63 (FIGS. 2, 3 and 5) extend between the back edge of baffle plate 58 and the top edge of baffle plate 59 and are formed with a plurality of rectangular-shaped openings 68 through which burner tips 9 extend. The various baffle plates discussed above form a baffle chamber 48, the bottom end 49 thereof being open to combustion chamber 5 and water tubes 13. A plurality of holes 65 are also formed in top baffle plate 63 and limit the amount and the velocity of the secondary air that reaches the central portion of the ends of the burner tips. Top baffle plate 63 is preferably tack welded to burner tips 9, but may be attached in other ways without affecting the concept of the invention. Burner tips 9 extend through baffle chamber 48 and beyond open end 49 thereof.

In accordance with another feature of the invention, the secondary air flowing through windbox 17 (arrow C, FIG. 2) is split into distinct streams. A portion passes through holes 65 of top baffle plates 63 at a velocity of $V_B$ (FIG. 6). This secondary air travels through baffle chamber 48 and along with the primary air and coal which exits burner tips 9, flows through slots 72*a* formed between roof tubes 13 at a velocity of $V_i$. This combined secondary and primary air supplies approximately 30% to 40% of the theoretical combustion air, with 100% of the theoretical air being the minimum amount theoretically required to support combustion, dependent upon the fuel's volatile content adjacent to the inner burner tips.

An additional amount of secondary air, indicated by arrow $C_4$, FIG. 6, flows down through gaps 66 and 67 and, along with a small amount of primary air and coal indicated by arrows D, which exits the left and right most burner tips, respectively, flows down through slots 72*b* at a velocity of $V_o$. This combined air supplies approximately 50% to 40% of the theoretical combustion air to the outermost burner tips. Thus, 80% of the theoretical air necessary to burn the coal is supplied by the primary air and these portions of secondary air. This 80% value is also not fixed and is dependent upon the coal's sulfur content and potential for furnace corrosion.

Top baffle plates 63 can be configured to allow the amount of secondary air which passes through the inside of baffle chamber 48 to match the volatile component of the coal, thus controlling the stoichiometry of the burner's core. As an example, if the volatile component of the coal is 30%, approximately 40% (including primary air) of the required theoretical combustion air is supplied through the baffle chamber 48 and slots 72*a* thus accounting for $V_i$. Top baffle plates 63 must be configured according to the particular coal used at each specific boiler site.

In accordance with still another feature of the invention, the total areas of holes 65 and gaps 66 and 67 of baffle assembly 39 provide an area of opening considerably smaller than the original windbox opening creating an additional pressure drop through burner 4. This added pressure drop is partially offset by redirecting a portion of the secondary combustion air through opening 35 and down the hot primary air duct 11 (FIG. 1) that already supply air to fans 10 as described above. An air plenum 74 which communicates with hot primary air duct 11 redirects this portion of the secondary combustion air and distributes this secondary combustion air to a plurality of modulating interjectory air ports 75. Each interjectory air port 75 is equipped with a register and drive 75*a*. Air plenum 74 is new and located on front wall 77 of combustion chamber 5 and extends along the full width of front wall 77 and communicates with the hot primary air duct 11 via a short run of new ductwork. Plenum 74 and air ports 75 are located approximately 20 feet below roof tubes 13 or approximately 40% to 60% of the distance between burner tips 9 and change of direction opening 14.

In accordance with another feature of the invention, boiler 1 includes one air port 75 for each burner 4. Air ports 75 supply approximately 20% of the theoretical combustion air along with any excess combustion air (typically 15%) and is termed "interjectory air" into combustion chamber 5 at approximately a 90 degree angle to burner tips 9 to provide the total combustion air within the combustion chamber. This interjectory air is necessary to complete char burn out and the oxidation of carbon monoxide. Injecting the streams of interjectory air at an approximate 90 degree angle to the direction of the burner tips 9 produces more turbulence at the tail end of the char burn out than exists with the original burners in order to thus optimize the final burner efficiency.

The one-to-one relationship between air ports 75 to burners 4 allows the final ratio of air-to-coal to be controlled on a per burner basis. Thus, the chemistry is closely controlled and held uniform between burners. Similarly, if a coal mill and its associated burners are off line, the respective interjectory air ports 75 and secondary air dampers are closed to prevent excessive cooling air from flowing into combustion chamber 5 and, therefore, maintain the desired chemistry at the remaining in service burners.

In accordance with still another feature of the invention, the method and apparatus for reducing $NO_x$ emissions from a multiple-intertube pulverized-coal burner can be utilized and retrofitted to both burners which discharge the primary air and coal over the furnace roof tubes, such as burner 4 shown in FIG. 4, and for burners which discharge the primary air and coal between the furnace roof tubes, such as burners 97 shown in FIG. 7. Each burner 97 includes burner tips 98 having tip nozzles 99 through which the coal and primary air are discharged. A gap 100 similar to gaps 66 and 67 of burner 4 is formed between one wall 101 of burner 97 and baffle plates 40–45. Alternatively, burner 97 can be converted to the burner 4 design by shifting the burners by one tube diameter, modifying the tip design and adding the burner 4 type tube protectors and steeple castings.

In accordance with a further feature of the invention, a plurality of probes measure the amount of primary combustion air, secondary combustion air and interjectory air supplied to each burner. Probes 105 are positioned between booster fan 10 and ball mill 2 and measure the amount of primary air (and coal, indirectly) supplied to each burner through coal pipes 3. Probes 106 are positioned in the inlet of windbox compartment 17 of burner 4 and measure the amount of secondary combustion air supplied through each windbox compartment 17. Probes 107 are positioned within the inlet to air plenum 74 to measure the total amount of interjectory air redirected to air plenum 74 and supplied to combustion chamber 5 through interjectory air ports 75. Each interjectory air port 75 also has a probe 108 to measure the individual port 75 air flow rate. These probes provide feedback to a usual command loop controller which controls the position of secondary air dampers 15 and the interjectory air port registers 75*a* based on the amount of primary air and coal supplied to each burner through coal pipes 3. A logic diagram showing the secondary air damper position as a function of steam flow of the boiler is shown in FIG. 8.

Figures 8, 8A:
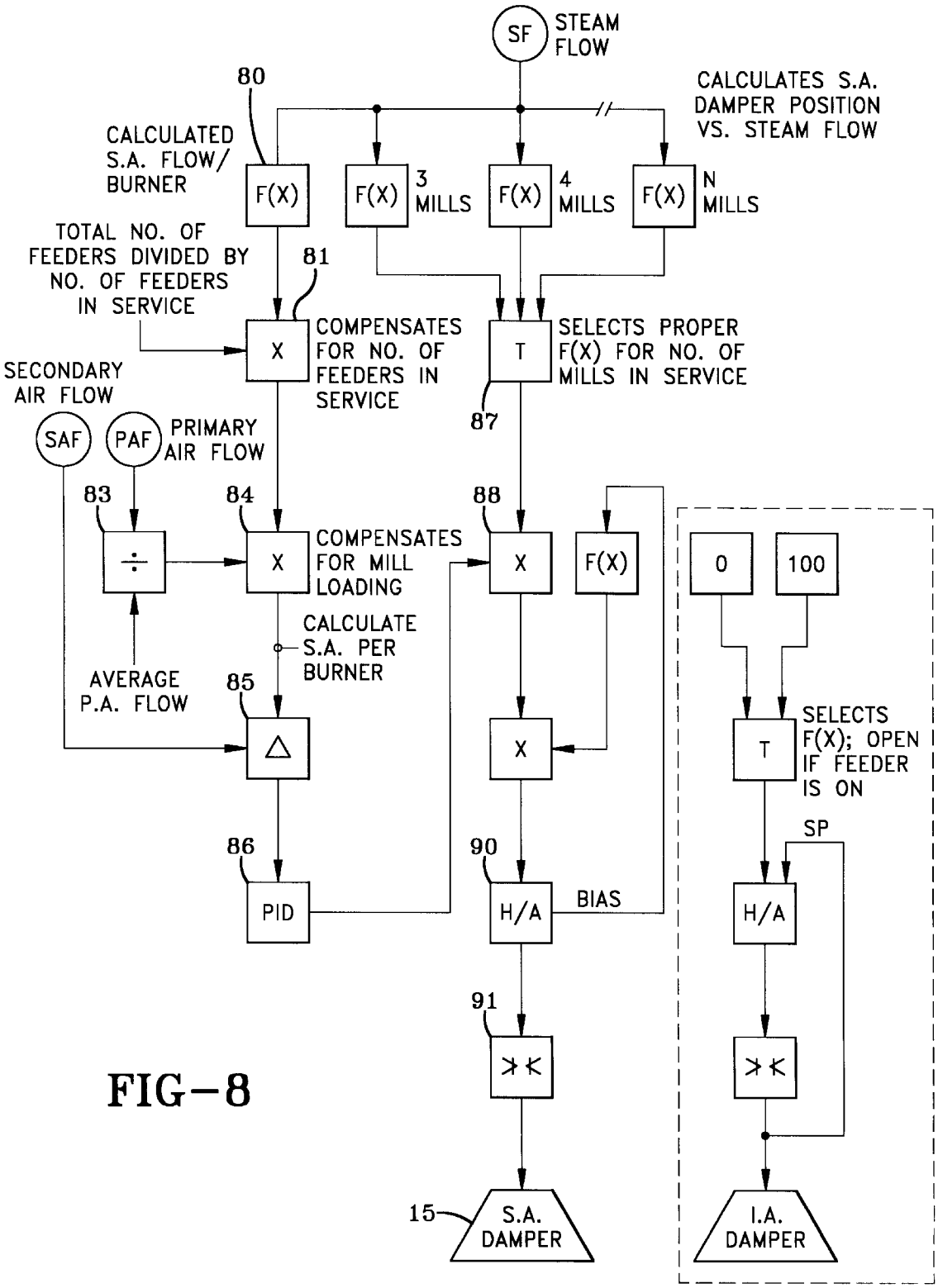
FIG. 8 is a logic diagram showing the control of the secondary air damper position as a function of steam flow, primary air flow and secondary air flow.
FIG. 8A is a logic diagram showing the control of interjectory air port damper position as a function of ball mill operation status.

Referring to FIG. 8, a boiler master or operator for a particular boiler knows the required amount of steam flow necessary for the boiler to produce a given amount of energy. The amount of the steam flow depends on the amount of coal provided to the burners and secondary air supplied to the burners, which is a function of the secondary air (S.A.) damper position. The steam flow (SF) required to produce the desired amount of energy is input into the control circuit. The secondary air flow per burner is calculated by a usual control circuit shown at 80 (assuming all mills in service) and is multiplied by the appropriate circuitry at 81 by the quotient of total number of feeders divided by the number of feeders in service.

The measured primary air flow (PAF) of each burner is compared with the average primary air flow of all the burners by a usual control circuit 83 and the calculated secondary air flow from circuit 81 is compensated for the burner's associated mill loading by a usual control circuit 84. That is, if a certain burner is receiving more primary air and thus more coal than the other burners, the secondary air for that burner will be compensated accordingly by circuit 84. The measured secondary air is compared with the calculated secondary air by a usual control circuit 85 and an error signal is output from a usual PID circuit 86.

A usual transfer circuit 87 selects the proper function F(x) for the number of mills 2 in service and a usual circuit 88 multiplies that function by the error signal sent from PID circuit 86. The output of circuit 88 is sent to a Hand/Auto or an air flow station 90 which sends a position signal to the secondary air dampers 15. Circuit 91 verifies that the signal sent to the secondary air dampers is within certain tolerances.

Referring to FIG. 8A, the interjectory air (I.A.) register position is calculated based on whether the coal feeder is in service. If the respective feeder is in service the interjectory air register position is equal to 100% and the register is open. If the feeder is out of service the interjectory air register position is equal to 0 and the register is closed. A set point (SP) allows the circuitry to track itself and make automatic adjustments. The open position is a function of both burner and interjectory air port position and is determined during initial system operation and optimization. Alternatively, the individual interjectory air port air flow probes 108 are used to control the interjectory air register 75*a* position based upon actual burner 4 coal input in the same fashion described above for the secondary air damper and flow control.

The various circuits discussed above and shown in block form in FIGS. 8 and 8A are well known to those skilled in power plant control circuits and thus are not described in further detail.

Accordingly, the method and apparatus of the present invention preferably is applied and retrofitted to usual roof fired boilers, such as those manufactured by Babcock & Wilcox. The apparatus is retrofitted to a multiple-intertube pulverized-coal burner by installing baffle plate assembly 39 within windbox 17 in the position described above. Probes 105 are placed within the primary air booster fan 10, probes 106 are placed within windbox damper inlet 15, probes 107 are placed within the inlet to air plenum 74 and probes 108 are placed within interjectory air ports 75 to measure the respective air flows. A command loop is installed to process the probe readings and a control mechanism is installed to control the position of secondary air dampers 15 and interjectory air register 75*a*. An outlet 78 is cut in hot primary air duct 11 and air plenum 74 is installed to communicate therewith. A plurality of front wall water tubes 26 are removed for the installation of each wall opening 76. A corresponding plurality of bent tubes are installed in front wall 77 of boiler 1 to comprise the circular wall openings 76 corresponding in number to the number of burners 4. Interjectory air ports 75 are installed within plenum 74 which communicate with front wall openings 76 for injecting the interjectory air into combustion chamber 5.

Accordingly, the method and apparatus of the present invention reduces $NO_x$ emissions from a multiple-intertube pulverized-coal burner by measuring the amount of primary air and coal which travels to each burner, the amount of secondary air which travels through windbox 17 and the amount of interjectory air supplied by interjectory air ports 75 and controls secondary air dampers 15 and interjectory air port registers 75*a* accordingly. The amount of secondary air used for combustion is internally staged by solid baffle plates 40–45, 58 and 59 and top perforated baffle plates 63 which includes holes 65. Additionally, the secondary air which flows through the baffled area provides approximately 30% to 40% of the required theoretical combustion air and travels at a substantially lower velocity than the secondary air which travels between gaps 66 and 67 and which provides an additional 50% to 40% of the required theoretical combustion air. This difference in air velocities provides for a fuel rich central core for combustion of the fuel's volatile component and an oxygen rich boundary layer which protects against reducing environments and corrosion potentials along waterwalls and provides sustained combustion of the fixed carbon.

Further, a portion of the secondary air is diverted through the hot primary air duct 11 where it is redirected to air plenum 74 and distributed to interjectory air ports 75 which inject individual streams of the intercepted air into combustion chamber 5 of boiler 1 at a 90 degree angle to the standard vertical flame direction. Also, a 1:1 ratio exists between burners 4 and air ports 75 which allows the streams of intercepted air to be controlled on a per burner basis. Furthermore, air plenum 74 and air ports 75 are positioned between 40% and 60% of the distance between burner tips 9 and change of direction opening 14. This both enlarges the flame zone and controls the heat release rate to reduce the potential for thermal $NO_x$ formation. The use of the burner baffling and interjectory air also controls the amount of excess oxygen available for the formation of $NO_x$ during both the volatile and char burn regions of each coal flame. Moreover, the method and apparatus for reducing $NO_x$ emissions from a multiple-intertube pulverized-coal burner of the present invention may be retrofitted to both types of burners, one of which discharges the primary air and coal above the tube protectors 12*a*, steeple castings 12*b* and roof tubes 13 (FIGS. 2, 3 and 4), and the other of which discharges the primary air and coal between roof tubes 13 (FIG. 7).

Accordingly, the improved method and apparatus for reducing $NO_x$ emission from a multiple-intertube coal-pulverized burner is simplified, provides an effective, safe, inexpensive, and efficient apparatus which achieves all the enumerated objectives, provides for eliminating difficulties encountered with prior apparatuses, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved method and apparatus for reducing $NO_x$ emission from a multiple-intertube coal-pulverized burner is constructed and used, the characteristics of the construction, and the advantageous, new and useful results obtained; the new and useful structures, devices, elements, arrangements, parts and combinations, and method steps are set forth in the appended claims.

We claim:

1. A method for reducing $NO_x$ emissions created upon the combustion of pulverized coal in a combustion chamber of a slotted roof fired boiler containing multiple-intertube pulverized-coal burners, said method includes the steps of:

providing a plurality of burner tips which communicate with the combustion chamber of the boiler;

providing a supply of heated air;

dividing the heated air into a supply of primary combustion air and a supply of secondary combustion air;

directing a first portion of the secondary combustion air toward the burner tips;

directing the primary combustion air through a hot primary air duct toward a source of pulverized coal;

combining the primary combustion air and pulverized coal with the first portion of the secondary combustion air adjacent the burner tips to provide an initial combustion air;

redirecting a second portion of the secondary combustion air as interjectory air into an interjectory air plenum;

injecting individual streams of the interjectory air from the interjectory air plenum and into the combustion chamber of the boiler; and injecting the individual streams of the interjectory air at a one-to-one ratio with the burners, one stream for each burner.

2. The method defined in claim 1 which includes the step of redirecting the second portion of the secondary combustion air through the hot primary air duct and into the interjectory air plenum.

3. The method defined in claim 1 wherein the first portion of the secondary combustion air and the combined primary combustion air and pulverized coal supply approximately 80% of a theoretical combustion air to the burner tips.

4. The method defined in claim 3 which includes the step of dividing the first part of the secondary combustion air into an inner part and an outer part wherein the outer part supplies approximately 50% to 40% of the theoretical combustion air to the outermost of the burner tips.

5. The method defined in claim 4 wherein the inner part of the secondary combustion air and the primary combustion air and pulverized coal supply approximately 30% to 40% of the theoretical combustion air to the inner burner tips.

6. The method defined in claim 1 in which the step of injecting individual streams of the interjectory air from the interjectory air plenum into the combustion chamber provides the balance of total combustion air injected into the combustion chamber.

7. The method defined in claim 1 further including the step of injecting the interjectory air at a substantially 90 degree angle to the direction of the burner tips.

8. The method defined in claim 1 including the step of adjusting a secondary air damper of the burners to regulate the supply of the first portion of the secondary combustion air.

9. The method defined in claim 1 including the step of controlling each individual stream of interjectory air into the combustion chamber with an interjectory air port and register.

10. The method defined in claim 1 which further includes the steps of measuring the primary combustion air, the first portion of the secondary combustion air and the interjectory air and adjusting all three in proportion to the pulverized coal for each burner using dampers and registers.

* * * * *